United States Patent [19]

Gervais et al.

[11] Patent Number: 4,563,136

[45] Date of Patent: Jan. 7, 1986

[54] HIGH TORQUE LOW SPEED HYDRAULIC MOTOR WITH ROTARY VALVING

[75] Inventors: Edward H. Gervais; Carle A. Middlekauff, both of Cumberland Center; Donald C. Wescott, West Baldwin, all of Me.

[73] Assignee: Parker-Hannifin Corporation, Cleveland, Ohio

[21] Appl. No.: 722,331

[22] Filed: Apr. 12, 1985

Related U.S. Application Data

[63] Continuation of Ser. No. 394,648, Jul. 2, 1982, abandoned, which is a continuation of Ser. No. 148,995, May 12, 1980, abandoned, which is a continuation-in-part of Ser. No. 90,274, Nov. 1, 1979, abandoned.

[51] Int. Cl.[4] ..... F03C 2/08; F04C 2/113

[52] U.S. Cl. ..... 418/1; 418/61 B; 418/186

[58] Field of Search ..... 418/57, 61 B, 71, 72, 418/186, 1

[56] References Cited

U.S. PATENT DOCUMENTS

| | | | |
|---|---|---|---|
| 2,989,951 | 6/1961 | Charlson | 418/61 B |
| 3,490,383 | 1/1970 | Parrett | 418/61 B |
| 3,680,989 | 8/1972 | Brundage | 418/71 |
| 3,825,376 | 7/1974 | Petersen et al. | 418/61 B |
| 3,846,051 | 11/1974 | McDermott | 418/61 B |
| 3,905,727 | 9/1975 | Kilmer | 418/61 B |
| 3,910,732 | 10/1975 | Lusztig | 418/61 B |
| 4,025,243 | 5/1977 | Stephens | 418/61 B |
| 4,139,335 | 2/1979 | Wusthof et al. | 418/61 B |
| 4,264,288 | 4/1981 | Wusthof et al. | 418/61 B |

*Primary Examiner*—John J. Vrablik

*Attorney, Agent, or Firm*—Hamilton, Brook, Smith & Reynolds

[57] ABSTRACT

A hydraulic torque motor and more particularly a hydraulic torque motor 10 of the internally generated rotor family having a rotatable inner rotor 24 and an orbital outer rotor 26 and which includes an improved rotary valve means 66 for the delivery and exhaust of hydraulic pressure fluid thereto and therefrom.

30 Claims, 8 Drawing Figures

HIGH TORQUE LOW SPEED HYDRAULIC MOTOR WITH ROTARY VALVING

DESCRIPTION

This application is a continuation of U.S. patent application Ser. No. 394,648 filed July 2, 1982, now abandoned, which was a continuation of U.S. patent application Ser. No. 148,995 filed May 12, 1980, now abandoned, which is a continuation-in-part of U.S. patent application Ser. No. 90,274 filed Nov. 1, 1979, now abandoned.

One commonly used form of modern compact hydraulic fluid pressure devices is generally referred to as gerotor and gerotor type motors and pumps, which are hereinafter collectively referred to as gerotor devices. Gerotor devices are generally manufactured in either of two forms, such forms being known as IGR or EGR devices, each of which include inner and outer rotors which are received within a locating ring or casing and are cooperable in a manner that a plurality of alternately expanding and contracting chambers are affected upon rotation of the rotors with respect to each other. The IGR device is a form wherein the gear teeth of the outer rotor are of a generated nature so as to provide conjugate interaction with the gear teeth of the inner rotor. Conversely, an EGR device is of a form wherein the gear teeth of the inner rotor are of a generated nature so as to provide conjugate interaction with the gear teeth of the outer rotor.

A significant problem to be overcome in utilizing IGR and EGR sets in motors is the means to operationally deliver and exhaust high pressure fluid to and from the gerotors. When IGR and EGR sets are utilized in a fixed non-orbiting fashion, a relatively simple porting and valving arrangement comprising two kidney-shaped ports separated by sealing lands is often successfully used; however, experience has shown that such a kidney-shaped porting arrangement is generally not applicable to IGR and EGR orbit motors. Accordingly, all modern approaches to IGR and EGR orbit motor designs utilize a structure wherein fluid is directed to and from the multiple chambers by means of a commutator arrangement which sequences the fluid to expanding chambers and from contracting chambers in a predetermined arrangement.

A major design consideration with IGR and motors utilizing a commutator arrangement involves the complex function of timing. Timing entails using a rotating valve for valving and metering of high and low pressure oil to and from the expanding and contracting pockets of the rotors the instant the pockets reach maximum or minimum volume. In order to accomplish such timing properly a plurality of precision valve parts (i.e. up to six) have been required with prior art devices. Many of these parts are in pressurized sliding contact which uses valuable flow and torque thereby substantially decreasing the motor efficiency. Furthermore means must be included to balance and lubricate the valve parts. An example of such a relatively complex prior art multi-component valve arrangement is illustrated in U.S. Pat. No. 3,572,983.

To achieve proper timing some prior art designs used an IGR or EGR arrangement in conjunction with a commutator section wherein the outer rotor is stationary and the inner rotor rotates and orbits. In such arrangements a flexible shaft or coupling, such as a splined "dog-bone" mechanism is necessary to transfer the rotating and orbiting motion of the inner element to purely rotating output motion. This type of arrangement has proven to present a number of problems or deficiencies; for example, the tooth-loading is relatively high since the inner rotor is supported and restrained only by the outer rotor; the dog-bone spline must be heavily crowned which may in turn result in high contact loads, wear and, because with a crowned spline torque capability is not improved as spline length increases, the dog-bone drive system results in high spline stresses with thicker gerotor sets and an underutilized spline for thinner gerotor sets. This latter deficiency dictates that, in practice, the IGR or EGR's having a thicker gerotor set is derated as to pressure in order to better insure a reasonable life for the dog-bone drive system. Furthermore, with an IGR motor of this type valving in the tooth space zone of the outer rotor is not readily accomplished due to the continuous generation of the outer rotor profile. Accordingly direct valving in the tooth space zone of the inner rotor of the IGR is preferred; however, due to the orbital movement of the inner rotor, is not practical.

With EGR motors of the type discussed immediately above as well as alternative EGR arrangements which have been used to overcome the splined dog-bone problems (i.e. See for example U.S. Pat. No. 3,512,905 which eliminates the dog-bone by fixing the inner rotor on a shaft and allowing the outer rotor to orbit but not rotate), problems become apparent. These other problems center around the use of an EGR motor. In order to achieve appropriate valving the fluid ports should be located in nonactive zones with respect to the working surfaces of the inner and outer rotors. Analysis of a conventional EGR set illustrates that all elements of the generated contour on the inner rotor are active at one time or another and that active portions of the teeth of the outer rotor are described by an arcuate segment of each circular lobe, the extremities of the arc being defined by the position of the seal points at closed mesh. Accordingly there is no zone on the inner rotor which may be utilized for valving and such valving may be accomplished only in the non-sealing portion of the contour on the outer rotor. Furthermore in instances where the outer rotor of the EGR gerotor set is orbiting about a circle of diameter equal to twice the gerotor set eccentricity and not rotating, all the valving must be accomplished in a width of two times eccentricity. Still further, due to the oribiting motion of the outer rotor, the velocity of the valve opening during portions of the cycle is essentially zero. The net effect of the above is poor valving conditions with a high pressure drop when a hydraulic torque motor is designed with an EGR set.

Through the use of the present invention which utilizes an IGR set having a restrained orbiting outer rotor and a rotating inner rotor which integrates the IGR set valving function on the face thereof the hereinabove mentioned problems and deficiencies of prior IGR and EGR motors are overcome.

Other advantages obtained with the present invention include: a straight thru shaft supported on bearings on both ends; the capability of extending the shaft thru the IGR motor for output on both ends; elimination of timing errors caused by torsional deflection; a reduction of tooth contact stresses between the inner and outer rotors; and the like.

Accordingly, it is one primary object of this invention to provide an IGR motor having an improved valve means which is integral with an inner rotating gerotor and which cooperates with a stationary commutator plate or section to provide a simple and efficient arrangement for the delivery and exhaust of hydraulic pressure fluid thereto and therefrom.

It is another object of this invention to provide an IGR gerotor set type motor which is relatively simple in construction and is operative in an efficient manner without the necessity of a dog-bone mechanism to translate rotating and orbiting motion to purely rotating output motion.

BRIEF DESCRIPTION OF THE DRAWINGS

These and other objects and advantages of the present invention will become more readily apparent upon a reading of the following description and drawings in which.

DETAILED DESCRIPTION

Figure 1:
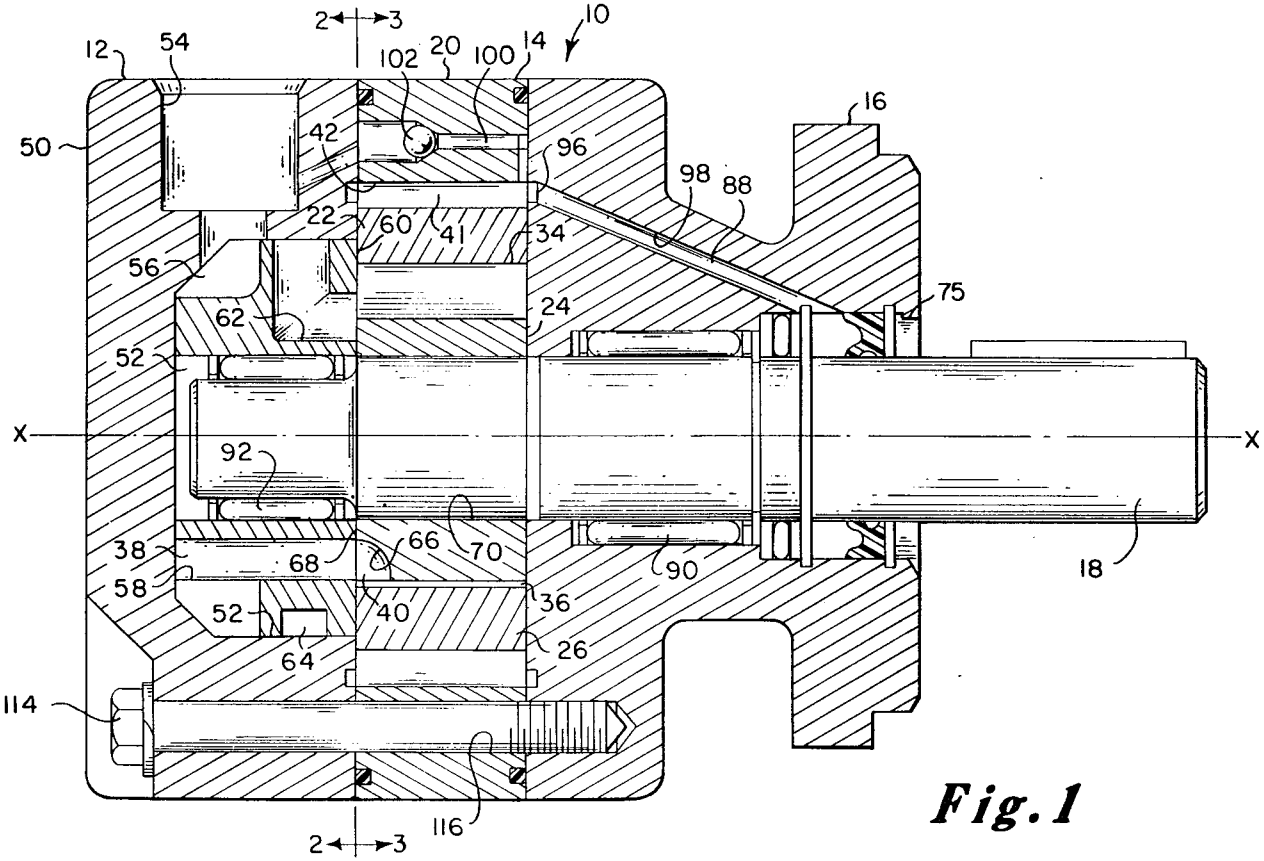
FIG. 1 is a longitudinal cross-sectional view of a gerotor device constructed in accordance with the principles of the present invention and taken on lines 1—1 of FIG. 2.

FIGS. 1 thru 4 illustrate a first embodiment of an elongated IGR motor constructed in accordance with the principles of the present invention and which is generally indicated at 10.

IGR motor 10 includes a plurality of axially aligned longitudinally adjacent sections which comprise: commutator and bearing section 12 at the fluid delivery and exhaust end or rear end of motor 10; a gerotor section 14 axially adjacent section 12; a fbrward bearing section 16 adjacent the work end or forward end of motor 10; and a work or output shaft 18 which is coaxially received within sections 12, 14 and 16 and extends forwardly of bearing section 16. For purposes of the description hereinbefore and hereinafter, forward and rearward shall refer respectively to longitudinally away from and towards section 12.

Gerotor section 14 includes a gerotor housing 20 which receives a gerotor set 22 therewithin. Gerotor set 22 comprises: an inner rotor 24 which is rotatable about a fixed axis X—X; and an orbitable rotor 26 which is non-rotatable as to axis X—X. Axis X—X is coincident with respect to the longitudinal axis of motor 10. The inner rotor 24 includes a plurality of circumferentially spaced tooth supporting portions 28 which in turn each include a radially inwardly directed outwardly open pocket 30 formed therewithin for respectively supporting solid metal cylindrical tooth members or rollers 32. The outer rotor 26 includes a plurality of circumferentially spaced inwardly directed teeth 34 which are of a generated nature so as to provide continuous conjugate interaction with the rollers 32 of the inner rotor 24. Rollers 32 are cooperable with the internal teeth 34 of the outer rotor 26 in a known manner to define pumping chambers 36 between circumferentially adjacent rollers 32.

High pressure hydraulic fluid is directed to and from gerotor set 22 to provide energy thereto which is converted thereby to rotative motion to drive output shaft 18. Such hydraulic fluid is directed to and from the IGR set 22 by means of the present invention which includes the use of a stationary commutator portion 38 of section 12 which is in timed communication with an IGR valve means 40 which is integrally formed with inner rotor 24. At this point it is to be noted that the particular embodiment of the IGR motor 10 which incorporates the invention herein is structured to be operative in a manner that the commutator portion 38 is timed to be cooperable with the integral valve means 40 to provide means for the delivery and exhaust of hydraulic fluid to and from the gerotor set 22 without the necessity of complex multi-component valving arrangements (i.e., See U.S. Pat. No. 3,572,983) and without the need for dogbone mechanisms (i.e., See U.S. Pat. Nos. 4,087,215 and 3,601,513). The specific arrangement and the detailed description therefor of all elements of the IGR motor 10 illustrated in FIGS. 1 thru 8, other than the improvement thereto through the use of the stress distribution and regulating means 11 of this invention, is illustrated and described in U.S. patent application Ser. No. 90,274 which was filed on Nov. 1, 1979 and is assigned to the same assignee as is this invention. Accordingly, reference is hereby made to the above-mentioned U.S. patent application Ser. No. 90,724.

IGR sets are operational as a result of the specific geometry thereof and the eccentricity that exists between the inner and outer rotor. Accordingly, in most instances of the utilization of an IGR, one of the rotors is orbital with respect to the axis of rotation of the other rotor. When utilizing IGR sets for orbit motor functions heretofore, it has been common practice to have the inner rotor orbital and to provide a dog-bone mechanism (i.e., see U.S. Pat. Nos. 4,087,215 and 3,601,513) to transfer the rotating and orbiting motion of the inner rotor to purely rotating output motion. The present invention, however, through the use of the stationary commutator portion 38 and the integral valve means 40, permits IGR motor 10 to be constructed with an inner rotor 24 which is rotatable about a fixed axis X—X.

Figure 2:
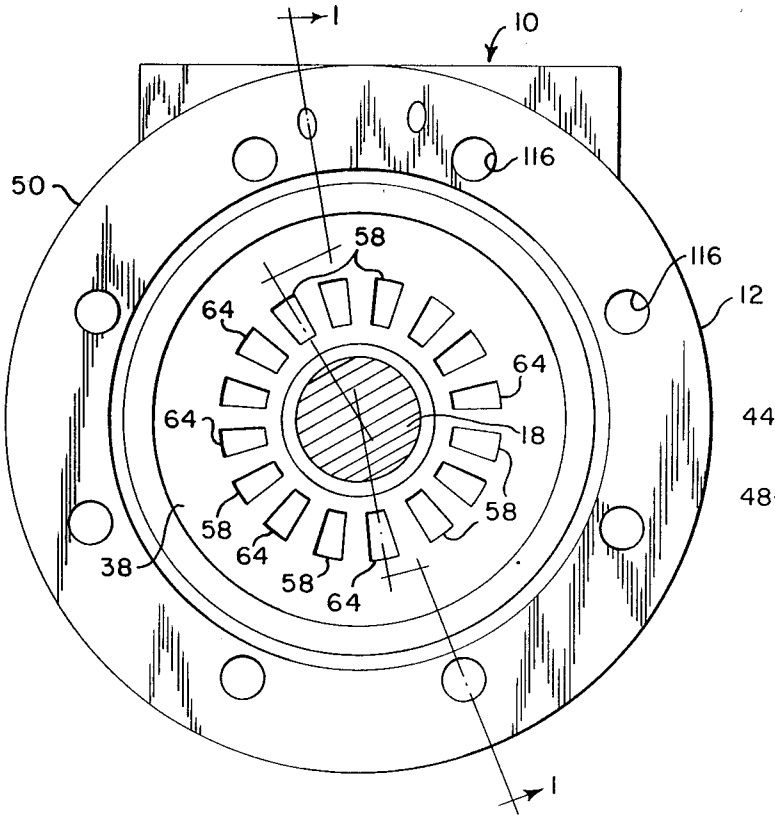
FIG. 2 is a transverse cross-sectional view taken on lines 2—2 of FIG. 1 and better illustrating a portion of the inlet and outlet commutator arrangement.
Figure 4:
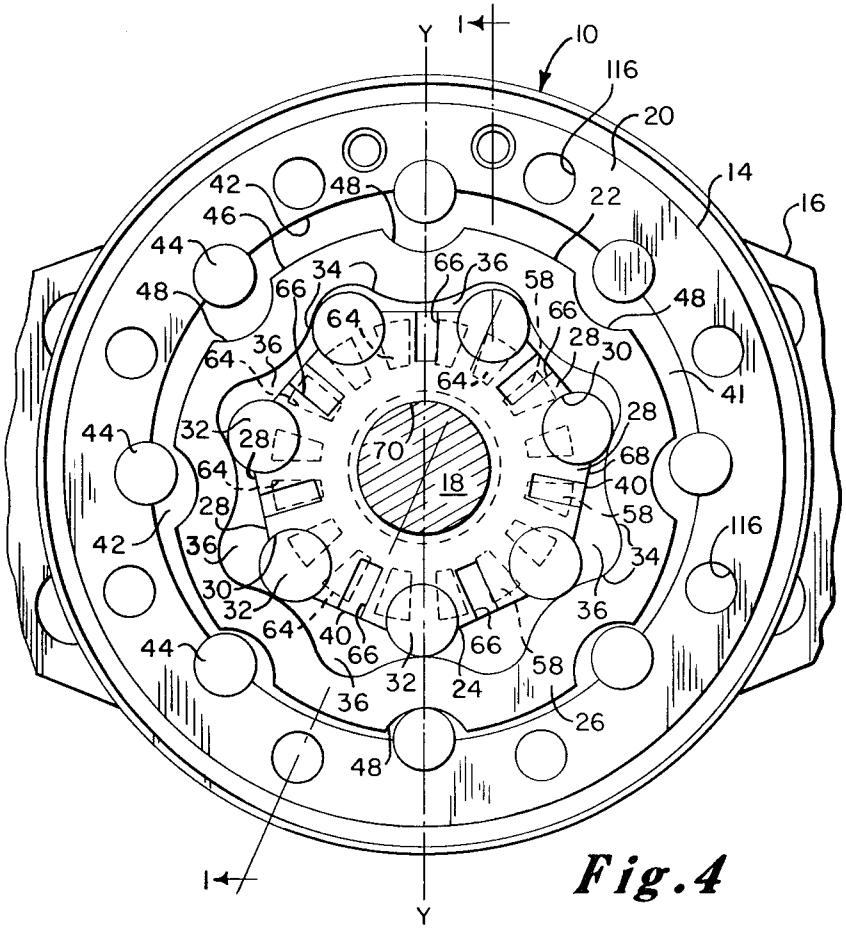
FIG. 4 is an enlarged transverse sectional view taken on lines 4—4 of FIG. 1 and particularly illustrating the IGR set, the integral valving on the inner rotor and, in phantom, the porting cooperation of the stationary commutator portion with such integral valving.

Commutator and bearing section 12 comprises a commutator and conduit carrying housing 50 which includes a forwardly open coaxial opening 52 therewithin; and a commutator portion 38 which is received within opening 52. High pressure hydraulic fluid is delivered to IGR motor 10 from a suitable fluid pressure source (not shown) through inlet conduit 54 which is formed within housing 50. An annular radially outwardly open commutator inlet passageway 56 is provided in commutator portion 38 adjacent the rear end thereof and is in hydraulic communication with the housing inlet conduit 52. High pressure hydraulic fluid thence flow around inlet passageway 56 through a plurality of high pressure feed passageways 58, as shown in FIGS. 2 and 4 eight passageways 58, to the IGR valve means 40. Feed passageways 58 are forwardly open at the forward face 60 of portion 38 and extend rearwardly therefrom to communicate with the annular commutator inlet passageway 56.

Commutator portion 38 additionally includes a plurality of low pressure hydraulic fluid exhaust passageways 62 which communicate between valve means 40 and an annular radially outwardly open commutator outlet passageway 64 which is formed in portion 38 at an outer peripheral location axially intermediate the inlet commutator passageway 56 and the forward face 60. The commutator passageway 64 is in hydraulic communication with a suitable outlet conduit (not shown) formed in housing 50 which in turn communicates with tank (not shown). Thus, the low pressure fluid exhaust passageway in conjunction with the outlet passageway 64 and the outlet conduit of housing 50, provides a path for the hydraulic fluid to exhaust from the IGR set 22.

As is best illustrated in FIG. 2, the open ends of passageways 58 and 64 at the face 60 lie in a common annulus and the inlet and exhaust passageways alternate with respect to the circumferential spacing thereof around such annulus. Thus, in the embodiment illustrated, there are eight outlet passageways 64 alternating with the eight inlet passageways 58.

The IGR valve means 40 are integrally formed with the inner rotor 24 and comprise a plurality of circumferentially spaced valving pockets 66 (only one being shown in FIG. 1) which are rotatable with inner rotor 24 into timed registration with respective inlet and outlet commutator passageways 58 and 64 for the entry and exhaust of hydraulic fluid from the pumping chambers 36 of the IGR set all in a manner as is fully illustrated and described in the above-mentioned U.S. Pat. application Ser. No. 90,274. Valving pockets 66 are formed at the rear or valve face 68 of inner rotor 24 and as shown extend forwardly therefrom a short distance to provide an open path between face 68 and adjacent radially outer peripheral portions of rotor. 24. As illustrated there is one valving pocket 66 equally spaced intermediate each adjacent pair of rollers 32.

FIG. 4 is a transverse cross-section at the IGR set 22 which clearly illustrates the orientation of valving pockets 66 at the valve face 68 and further includes the operational orientation of inlet and outlet passageways 58 and 64 superimposed on face 68 with dotted lines. It is to be understood that the dotted representation of passageways 58 and 64 in FIG. 4 is for purposes of description only and would not normally appear in the section cut as FIG. 4. Furthermore, as viewed in FIG. 4, the IGR set 22 will drive the shaft 18 in a clockwise direction and the full and open mesh orientation of the rollers 32 with respect to the teeth 34 are respectively illustrated at the top and bottom of FIG. 4.

Again as viewed in FIG. 4 and with consideration of the description hereinabove, the pumping chambers 36 to the right of the vertical axis Y—Y drawn through the full and open mesh orientation of rollers 32 and teeth 34 are at high pressure and in communication with the high pressure hydraulic fluid source and the pumping chambers 36 to the left of the axis Y—Y are at low pressure and are in communication with tank. The pumping chamber 36 between the teeth 34 at the full mesh position is a transition volume and is not in communication with either the high pressure fluid source or with tank. The valving pockets 66 on the high pressure side of the IGR set 22 are oriented with respect to the feed passageways 56 such that high pressure hydraulic fluid will be in communication, with the respective high pressure pumping chambers 36 by means of a respective valving pocket 66 therefor registering with an inlet feed passageway 58 which in turn is in communication with the high pressure hydraulic fluid source via the annular commutator inlet passageway 38 and the inlet conduit 54. Similarly, the valving pockets 66 on the low pressure side of the IGR set are oriented such that the low pressure pumping chambers 36 will be in communication with tank by means of respective valving pockets 66 therefor registering with an exhaust passageway 62 which in turn is in communication with tank via the annular commutator outlet passageway 64 and the outlet conduit which is formed in housing 50.

Outer rotor 26 is supported and structured to be orbitable through a limited path but still be restrained from rotation about the axis X—X. To achieve this objective, while still providing means for the reversal of the IGR set 22 (i.e., clockwise and counterclockwise rotation of shaft 18), the inner peripheral surface 42 of gerotor housing 20 is of a diameter larger than the outer diameter of the outer rotor 26. To guide the outer rotor 26 throughout the predetermined rotationally restrained orbitable path thereof, a plurality of circumferentially spaced guide rollers 44 are positioned at the peripheral surface 42 for registry with a plurality of circumferentially spaced outwardly open pockets 48 which are formed within the outer peripheral surface 46 of outer rotor 26. The arcuate extent of the pockets 48 is greater than the diameter of the rollers 44 to thus provide for the orbitable movement thereof within the confines of the respective pockets 48.

Figure 3:
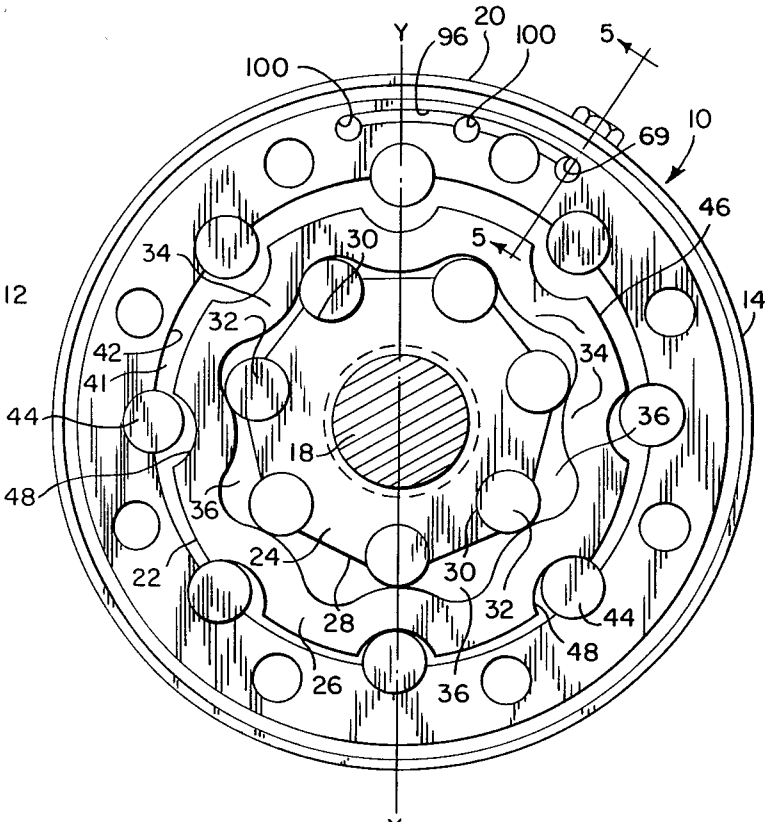
FIG. 3 is a transverse sectional view taken on lines 3—3 of FIG. 1 and particularly illustrating the gerotor set and also the stress distribution and regulating means for the control of the hydraulically induced hoop stress at the outer rotor.

As viewed in FIG. 3, the IGR set 22 will drive the shaft 18 in a clockwise direction and the full and open mesh orientation of the rollers 32 with respect to the teeth 34 are respectively illustrated at the top and bottom of FIG. 3. The pumping chambers 36 to the right of the vertical axis Y—Y drawn through the full and open mesh orientation of rollers 32 and teeth 34 are at high pressure and in communication with the high pressure hydraulic fluid source and the pumping chambers 36 to the left of the axis Y—Y are at low pressure and are in communication with tank. The pumping chambers 36 between the teeth 34 at the full mesh position is a transition volume and is not in communication with either the high pressure fluid source or with the tank.

With the orientation and structure as described hereinabove, as well as the fact that the IGR valve means 40 is integral with the rotor 24, the IGR set 22 provides a self-timing valving function in conjunction with the commutator portion 38, the high pressure fluid flows to the high pressure pumping chambers 36 via the registry of respective valving pockets 66 and feed passageways 58. The pumping chambers 36 are expanding in volume in the clockwise direction of rotation on the high pressure side of axis Y—Y and are contracting in volume on the low pressure side of axis Y—Y. The energy of expansion of the pressurized fluid results in the clockwise rotation of the inner rotor 24. The registry of the respective pockets 66 with the exhaust passageways 62 on the low pressure side of axis Y—Y provides a path for the timed or simultaneous exhaust of relatively low pressure hydraulic fluid from motor 10.

The pressurized fluid results in the clockwise rotation of the inner rotor 24. The motor output shaft 18 includes a portion thereof which passes through an axial opening 70 (FIG. 1) of inner rotor 24. Shaft 18 is suitably rotatably keyed to inner rotor 24 for coaxial rotation therewith at the outer peripheral portion thereof adjacent the periphery of opening 70. The rear portion of shaft 18 is received within opening 52 and suitably rotatably supported therein, for example by rear roller bearing means 92 (FIG. 1). Shaft 18 extends forwardly through bore 75 and an intermediate portion thereof is suitably rotatably supported therewithin, for example by forward roller bearing means 90.

The high pressure hydraulic fluid acts within the high pressure pumping chamber 36 to cause the inner rotor 24 to rotate about axis X—X in a clockwise direction as viewed in FIG. 4 while simultaneously resulting in the outer rotor 26 orbiting in a counterclockwise direction while being restrained in rotation about axis X—X. As discussed hereinbefore, the orbital path for the outer rotor 26 and the restraint on rotation thereof is defined and described by the structure and cooperation between the operative guide rollers 44 and the pockets 46. As can be best seen in FIG. 4 the rollers 44 and pockets 48 which are operative when the IGR set 22 is functioning to drive the shaft 28 in a counterclockwise direction are those which are positioned in the lower half of the IGR set 22.

At this point it is important to note that the embodiment of the invention described herein is designed to permit reversal of rotation of the IGR set 22. If it were desired to cause shaft 18, when viewed in FIG. 4, to rotate in the the counterclockwise direction, the function and description of the various inlet and outlet passageways or conduits, high and low pressure pumping chambers, the tank and fluid pressure communications and the like, will be reversed from the description and function heretofore.

An additional feature of the invention herein is that by using the rollers 44, in conjunction with lubricating means 98 (FIG. 1) which will be discussed hereinafter, hydraulic fluid is provided in the area 41 (FIG. 1) intermediate the outer rotor 26 and a housing inner peripheral surface 42. Thus a hydrodynamic oil film will be established between rollers 44 and the adjacent pockets 48 which will decrease the frictional resistance to outer rotor 26 during the orbital movement thereof and, hence, increase the efficiency of the IGR 10. A further advantage in using the rollers 44 is in the roller line contact with respective pockets 48 therefor which will yield low stresses at the pockets 48 and the resultant ability to use a soft powder metal material for the gerotor housing 20. Thus, the roller 44—pocket 48 arrangement will result in extremely low mechanical stresses, precise locating ability of the outer rotor 26, and relatively low internal stresses.

Lubricating means 98 is structured in any suitable manner to provide low pressure hydraulic fluid to the area 41 intermediate rotor 26 and the housing inner peripheral surface 42. Lubricating means 98 additionally includes a lubrication passageway 88 within forward bearing section 16 which extends forwardly from area 41 through bore 35 to thus provide lubrication to the forward roller bearing means 90. A pressure relief passageway 84, which as shown has a one way ball check valve 102 therein, extends from area 100 to inlet conduit 54 to provide a means to relieve the pressure within area 41 in the event such pressure exceeds a predetermined maximum.

Figure 6:
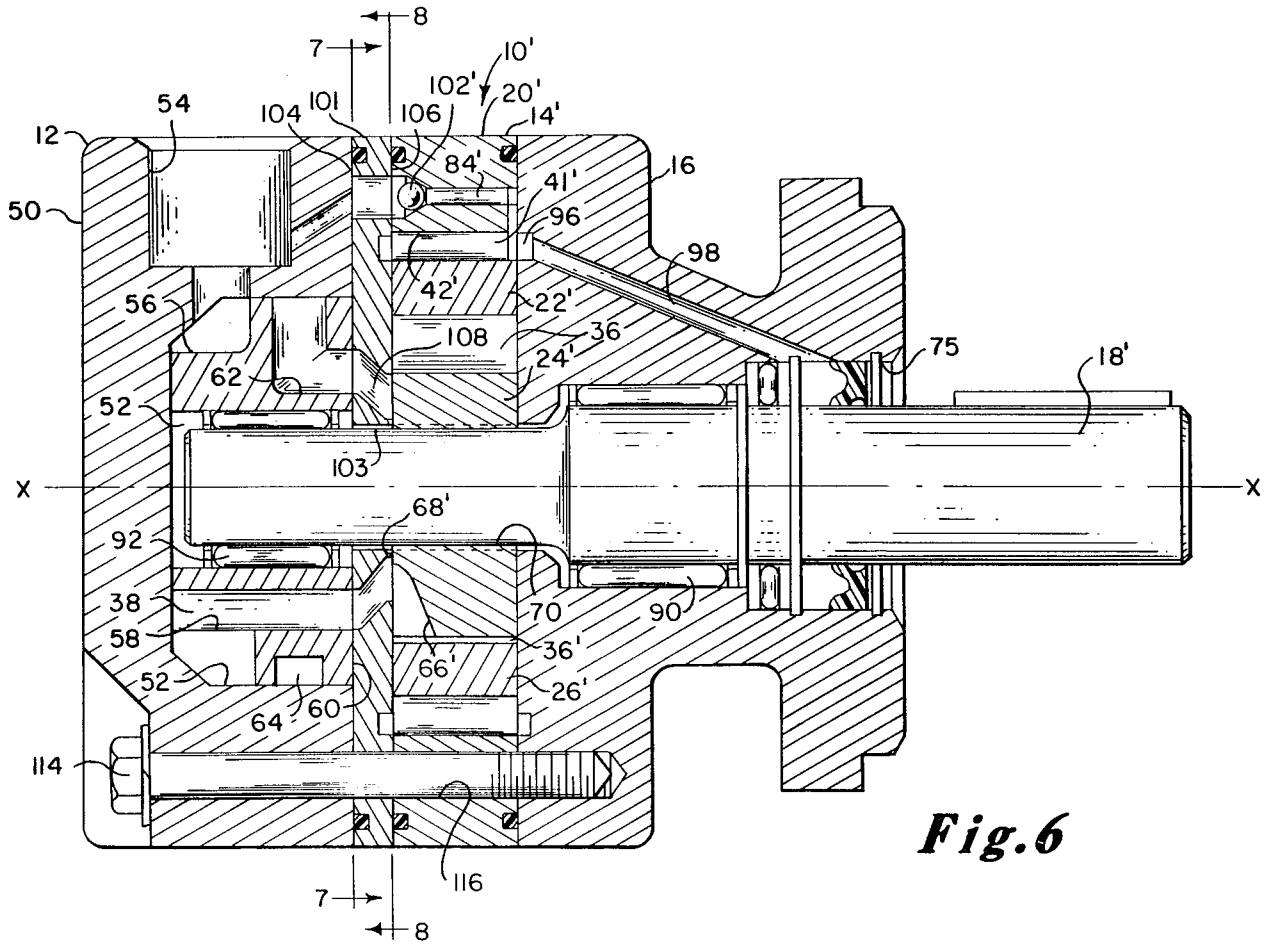
FIG. 6 is a longitudinal cross-sectional view of another embodiment of an IGR motor constructed in accordance with the principles of the present invention and which includes a stationary transition plate located intermediate the commutator portion and the IGR set.
Figure 8:
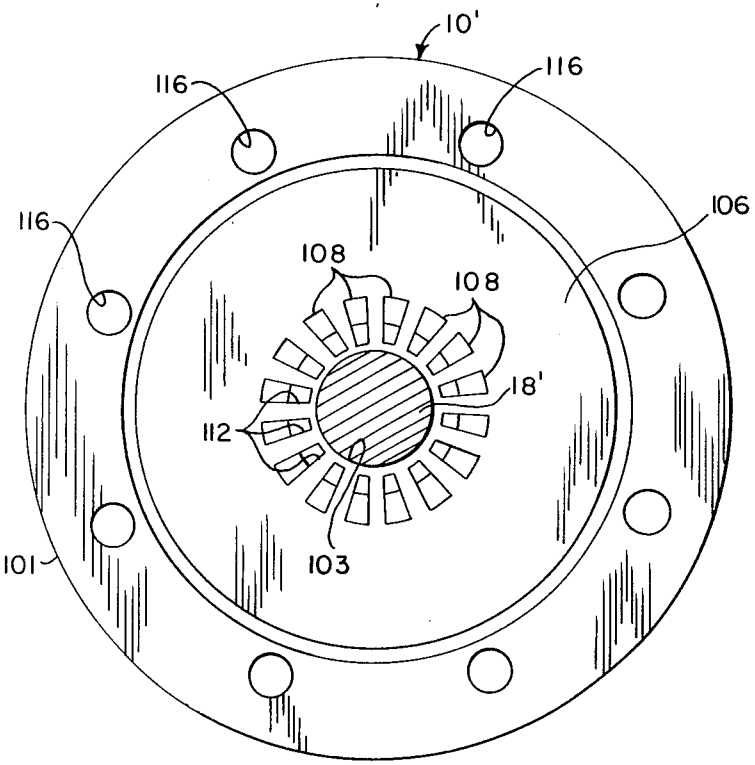
FIG. 8 is a transverse sectional view taken on lines 8—8 of FIG. 4 and particularly illustrating the side of the transition plate which is adjacent the IGR set.
Figure 7:
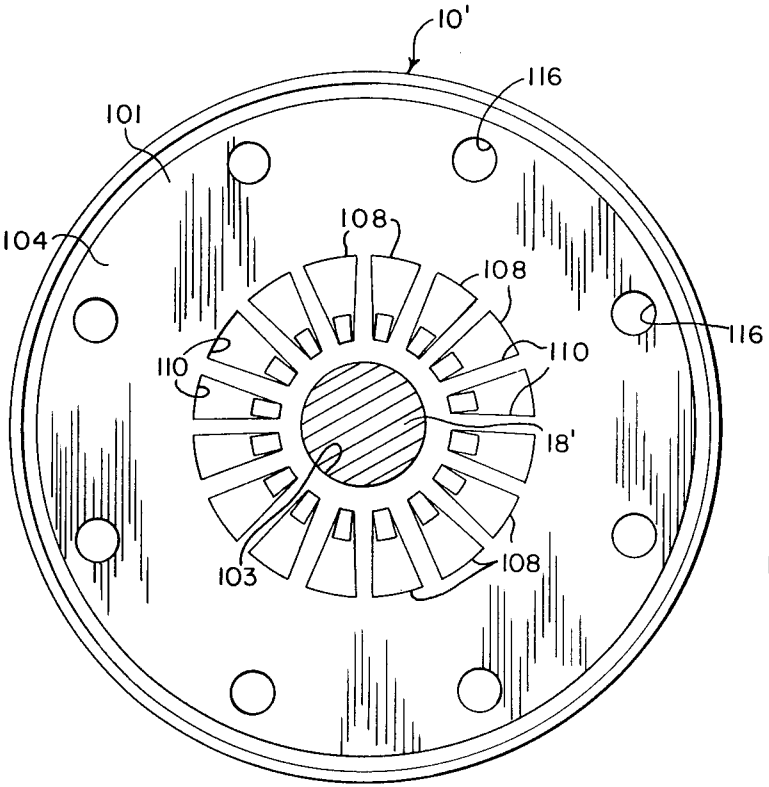
FIG. 7 is a transverse sectional view taken on lines 7—7 of FIG. 4 and particularly illustrating the side of the transition plate which is adjacent the commutator portion.

FIGS. 6, 7 and 8 illustrate an alternative embodiment of an IGR motor 10' which is constructed in accordance with the principles of the present invention. IGR motor 10' is essentially identical in all respects to the IGR motor 10 described hereinbefore with the primary distinction therebetween being that IGR motor 10' additionally includes a stationary transition plate 101 coaxially disposed longitudinally intermediate commutator and bearing section 12 and gerotor section 14. Transition plate 101, which has a generally circular cross section with a central coaxial bore 103 for receiving shaft 18 therethrough, is interfaced between sections 12 and 14 such that the rear face 104 thereof abuts the commutator forward face 60 and the forward face 106 thereof abuts the valve face 68. A plurality (as shown 16) of circumferentially spaced transition through passageways 108 are provided in plate 101 which each have an enlarged open end 110 thereof at rear face 104 and which taper forwardly and radially inwardly therefrom to the forward open end 112 thereof at the forward face 106.

The circumferential spacing of passageways 108 is such that when assembled within the IGR motor 10' the rear ends 110 of every other passageway 108 is in open communication with respective commutator inlet feed passageways 58 at the commutator forward face 60 and the rear ends 110 of the other alternate passageways 108 are in open communication with respective commutator outlet passageways 62 at the face 60. Thus, the passageways 108 may be considered as stationary extension of the passageways 58 and 62 and are in timed communication with pumping chambers 36' of IGR set 22' in the same operational manner as described hereinbefore with respect to the direct timed communication of the passageways 58 and 62 with the pumping chambers 36 of the IGR set 22.

However, as best illustrated in FIG. 6, the transition plate 101 including a sloping transition of the passageways 108 to thus communicate the inlet and outlet of hydraulic fluid to and from the pumping chambers 36' of IGR set 22' at a location displaced radially inwardly from the pockets 30 and rollers 32 of the inner rotor 24. This communication arrangement may be of importance in certain high pressure situations to alleviate a potential leakage path at the pockets of 30 and rollers 32. Such a leakage path may develop because the radial clearance in the pockets 30 of 0.002 inches or 0.003 inches is not substantial at moderate pressures; however, at extremely high pressures, leakage at the clearances of pockets 30 may affect operational efficiency and/or present certain maintenance problems. Additionally, the inclusion of the transition plate 101 permits the use of more conventional pressure compensation techniques for high pressure operation if desired (i.e. a bleed path intermediate spaced pairs of seals and the like).

A still further advantage which arises from the use of the transition plate 101 is the capability of a family of IGR motors 10 and 10' wherein the commutator and bearing section 12 and the forward bearing section 16 are standard and differing transition plates 101 are incorporated to compensate for differing width IGR sets and/or for IGR sets having differing operating pressures. Still further, the inclusion of the transition plate 101 can be utilized to reduce the manufacturing tolerances of the IGR motor at 10', particularly the tolerances of the commutator and bearing section 12.

With both the IGR motors 10 and 10', the various longitudinally aligned sections thereof may be restrained in operational position in any suitable manner. As shown, a plurality of spaced bolts 114 are received within respective aligned bores 116 therefor and tightened to align the IGR motor sections and to releasably retain them in the respective operational positions thereof. Bores 116 are circumferentially spaced, extend along respective axes therefor which are parallel to the axis X—X and extend within the various sections at a location radially inwardly adjacent the outer peripheries of the sections.

The high pressure of the hydraulic fluid delivered to the IGR motor 10 results in an outwardly directed force on the inner peripheral surface of the outer rotor 26 which in turn may result in a substantial stress therein which must be considered in the structural design of the outer rotor 26. Thus, in addition to the stress conditions in the outer rotor 26 which are predicated on normal operating torque reactions, the hydraulically induced stress therein will be directly proportional to the pressure of the high pressure hydraulic fluid unless alternative stress distribution arrangements are incorporated within the IGR motor 10. It is specifically to such an alternative stress distribution arrangement that the pressure regulating means 11 of the present invention is directed.

Figure 5:
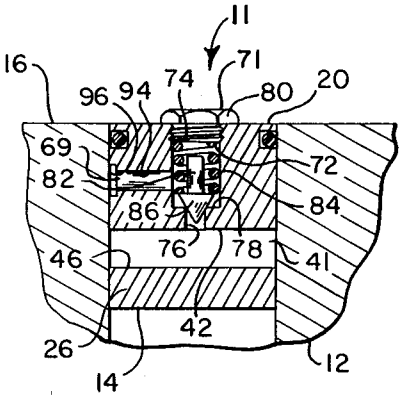
FIG. 5 is a partial cross-sectional view taken on lines 5—5 of FIG. 3 through the valve assembly of the stress distribution and regulating means.

As shown in FIGS. 3 and 5 stress distribution and regulation means 11 comprises: the chamber 41; pressure relief passageway means 69; and a one-way pressure regulating means shown schematically as pressure regulating valve 71 which provides pressure responsive communication between chamber 41 and relief pressure passageway means 69. Generally, with such an arrangement of distribution and regulating means 11, a controlled quantity of high pressure hydraulic fluid from the high pressure pumping chambers 36 leaks across the forward and rear faces of the gerotor set 22 due to a predetermined longitudinal working clearance thereof. This high pressure hydraulic fluid pressurizes chamber 41 and causes a resultant outwardly directed force at the inner peripheral surface 42 of housing 20 and an inwardly directed force at the outer peripheral surface 46 of the outer rotor 26. This inwardly directed force on surface 46 results in a hoop stress at outer rotor 26 which opposes the outwardly directed internal stresses created therein due to the working high pressure fluid in the high pressure pumping chambers 36. Thus, the resultant hydraulically induced stress in outer rotor 26 is proportional to the working stress form the high pressure fluid less the hoop stress effect on rotor 26 from the stress distribution and regulating means 11. Furthermore, the pressure regulating valve 71 is set by suitable means (i.e., by selection of spring constant, stroke, area and the like) to allow only a predetermined maximum pressure within the chamber 41. Once this pressure is reached, the valve 71 will open thereby allowing the high pressure fluid to pass from chamber 41 to relief passageway means 69 and thence to tank.

It can now be seen that the stress distribution and regulating means 11 obviates the necessity to design the outer rotor 26 for the maximum operating pressure of the gerotor set 10. Furthermore, the stress generated by the high pressure fluid is now "shared" by both the gerotor housing 20 and the outer rotor 26. The degree of "sharing" between the housing 20 and the outer rotor 26 is regulated by the pressure regulating valve 71. Still further, as will be described hereinafter, the control afforded by stress distribution and regulating means 11 will not be affected by the direction of rotation of the shaft 18.

As is best seen in FIGS. 3 and 5, pressure regulating valve 71 is axially received within a stepped bore 72 which extends radially between the outer periphery of the gerotor housing 20 and the chamber 41. Bore 72 includes a radial outermost portion 74 and a reduced diameter portion 76 which extends radially inwardly from portion 74. A valve seat 78 is formed at the juncture of bore portions 74 and 76. Valve 71 comprises: an end cap 80 which is received within the radially outermost end of bore portion 74; a plunger 82 which is axially reciprocal within bore portion 74; and a biasing means, such as spring 84, which extends axially between end cap 80 and a flanged portion 86 of plunger 82 to normally bias plunger 82 into engagement with valve seat 78, thus interrupting hydraulic communication between the chamber 41 and the pressure relief passageway means 69.

Forward and rear roller bearing means 90 and 92 are respectively positioned within sections 12 and 16 in a known manner; for example, as is illustrated in FIG. 1 and as is shown in the aforementioned U.S. patent application Ser. No. 090,274 and detailed above. Normal leakage adjacent the inner rotor 24 provides the necessary hydraulic fluid for the lubrication of bearing means 90 and 92. To prevent an inordinate load on the seal forwardly of bearing means 90 due to excessive pressure of hydraulic fluid intermediate the shaft 18 and the forward seal, a seal pressure relief means 88 is provided.

The seal pressure relief means 88 is structured in any suitable manner and as shown comprises: a forwardly open arcuately extending groove 96 within the forward face of the gerotor housing; a relief passageway 98 formed within bearing section 16 which extends forwardly from the groove 96 to an area forwardly adjacent the forward bearing 90; and a pair of pressure relief passageways 100 in hydraulic communication with groove 96 at the forward ends thereof and which, as shown, each have one-way ball check valves 102 therewithin. The rear ends of the relief passageways 100 are respectively in suitable hydraulic communication with a respective inlet conduit 54 and outlet conduit (not shown). Hydraulic pressure fluid will only be relieved over the passageways 100 which is in communication with the one of the inlet and outlet conduits which is at low pressure while the high pressure fluid from the other conduit will cause the respective check valve 102 to close the other passageway 100. Thus, the particular passageway 100 which is functioning in a relief capacity is dependent on whether the gerotor device 10 is being used as a pump or a motor and also is dependent on the direction of rotation of the shaft 18.

The pressure relief passageway means 69 may be directly in communication with tank or with the conduit having low pressure hydraulic fluid therein; or, as is indicated in the embodiment illustrated, may communicate with the seal pressure relief means 88 (FIG. 1) and as such would comprise a longitudinally extending bore 94 (FIG. 5) within the housing 20 which communicates at one end thereof with bore portion 74 radially outwardly from seat 78 and at the other end thereof with the groove 96. Thus, with such an arrangement and because of the inclusion of the pressure regulating valve means 11, the pressure of the lubricating fluid will be independent of the pressure of the hydraulic fluid within chamber 41. However, when the pressure of the hydraulic fluid within chamber 41 overcomes the preset bias of the regulating valve 71, the excess fluid from the chamber 41 will be relieved through the operative relief passageway 100 (FIGS. 1 and 3) of the seal pressure relief means 88 and no damage to the bearings or seals of the IGR motor 10 will be sustained for the relatively high pressure hydraulic fluid from chamber 41 will always be isolated from the bearings and seals by subsequent relief through the operative relief passageway 100.

The embodiments described herein are the presently preferred embodiments of IGR motors constructed in accordance with the principles of the present invention; however, it is understood that various modifications may be made to the embodiments described herein by those skilled in the art without departing from the scope of the invention as is defined by the claims set forth hereinafter. For example: the IGR sets 10 and 10' may be structured with integral teeth at the inner rotors thereof rather than roller teeth; other arrangements for guiding, but rotatably restraining the outer rotors 26 and 26' may be utilized; and the like.

We claim:

1. A method of utilizing pressurized fluid to produce rotary motion comprising the steps of:

injecting said fluid into a motor housing; directing said fluid to a plurality of commutator ports;

selectively transmitting said fluid through rotary valve means carrying N valve ports rotatable about a central axis to N sealed variable volume chambers formed between a gear like N toothed inner member with tooth root sections and intermediate tooth crown sections located between said tooth root sections mounted for rotation about said central axis and an annular outer member having a further axis circularly moveable about said central axis without rotation about said further axis, said outer member having an inner peripheral surface of N+1 generated arcuate teeth, said teeth's profile having a continuously changing radius of curvature which provides for continuous cooperative contact with said toothed inner member to form said N sealed variable volume chambers and wherein such selective transmission of fluid occurs when the valve ports are aligned with the tooth root sections of the inner member;

selectively expanding some of said sealed chambers by providing a pressure differential between said sealed chambers in order to produce a rotary motion with said inner member;

withdrawing through said valve means said fluid from chambers that have reached their maximum expansion; and removing said fluid from said housing.

2. The method of utilizing pressurized fluid to produce rotating motion recited in claim 1 further comprising the step of:

orbiting said outer member's center axis about the axis of rotation of said inner member during the rotation of said inner member.

3. A motor comprising:

a. a motor housing having a motor inlet and a motor outlet port for the entry and exit of fluid to and from the motor;

b. a shaft mounted within said motor housing for rotation about a fixed longitudinal axis;

c. an inner member mounted upon said shaft for rotation about the fixed longitudinal axis of said shaft, said inner member having N circumferentially spaced external teeth with non-fluid sealing portions located between the external teeth;

d. an outer member mounted within said motor housing for orbital nonrotational movement in respect to the fixed axis of the shaft;

e. N+1 generated, non circular, internal arcuate teeth on the inner peripheral surface of said outer member, said teeth having a profile with a continuously changing radius of curvature, said teeth providing continuous cooperative interaction with the teeth of the inner member, to thereby define with with the teeth of said inner member N circumferentially spaced chambers;

f. a stationary commutator having N+1 commutator inlet ports and N+1 commutator outlet ports circumferentially spaced and adjacent each other, said commutator inlet and outlet ports being in fluid communication with the respective motor inlet and motor outlet ports, and g. valve means adjacent said commutator inlet and outlet ports and having N valve ports aligned with non-fluid sealing portions of the inner member external teeth, said valve means disposed for rotation about the fixed longitudinal axis for providing fluid communication between said commutator inlet and outlet ports to and from said chambers formed between the teeth of said inner and outer members when said valve ports are aligned with said commutator ports.

4. A hydraulic motor as specified in claim 3 further comprising control means which limits fluid pressure at the outer periphery of said outer member.

5. The apparatus recited of claim 3 wherein said teeth, arranged on said inner member, comprise rollers positioned in pockets at equidistant locations on said inner member's outer peripheral surface.

6. The apparatus of claim 3 wherein said external teeth arranged on said inner member are peripherally connected by straight flat sections which comprise the non-fluid sealing portions.

7. The apparatus of claim 3 wherein said outer member is rotationally restrained by rollers fixedly positioned within said motor housing's inner circumferential surface, said outer member's outer peripheral surface having scalloped portions for periodic reception of said housing rollers during motor operation.

8. A hydraulic motor comprising:

a. a housing having inlet and outlet hydraulic fluid ports therein;

b. a set disposed within said housing and comprising an externally extending N toothed inner member with flat non-active portions between the teeth, said inner member being rotatable about a central axis and and an internally generated internally extending N+1 toothed outer member circularly moveable about said central axis but non-rotatable about its own axis, said outer member's internal teeth having a profile with a continuously changing radius of curvature, said outer member cooperable with said inner member to define N circumferentially spaced variable volume chambers between adjacent toothed surfaces thereof;

c. cooperable means carried by said outer member and an adjacent portion of said housing to allow said outer member to move about said central axis during the rotation of said inner member but to prevent rotation of said outer member about its own axis;

d. a stationary commutator portion of said housing having a circumferentially spaced plurality of hydraulic fluid inlet passageways which circumferentially alternate with a plurality of circumferentially spaced hydraulic fluid outlet passageways, said inlet and outlet passageways being in respective fluid communication with said inlet and outlet ports; and, e. valve means rotatable about said central axis in synchronization with said inner member and disposed adjacent said inlet and outlet passageways to provide N synchronized hydraulic communication paths between said inlet passageways and those N variable volume chambers on the high pressure side of said gear set and between said outlet passageways and those of said N variable volume chambers on the low pressure side of said gear set.

9. A hydraulic motor as specified in claim 8 wherein said rotationally restrained path of said outer member is substantially an orbital path.

10. A hydraulic motor as specified in claim 8 wherein said inner member's external teeth comprise equidistant rollers separated by inactive straight portions, which do not contact said outer member.

11. A hydraulic motor as specified in claim 8 further comprising control means which limits fluid pressure at the outer periphery of said outer member.

12. A hydraulic motor as specified in claim 8 wherein said set is selectively reversible.

13. A hydraulic motor as specified in claim 8 wherein the number of said inlet passageways and the number of said outlet pasageways are each one greater in number than the number of external teeth on said inner member.

14. A hydraulic motor as specified in claim 8 wherein said cooperable means of said outer member and housing comprises a plurality of circumferentially spaced elongated roller means which are positioned within the adjacent inner periphery of said housing and which cooperate with a plurality of circumferentially spaced elongated radially outwardly open pockets within the outer periphery of said outer member to provide said outer member with rotationally restrained orbitable path.

15. A hydraulic motor as specified in claim 14 wherein the arcuate extent of said pockets at the outermost periphery of said outer member is greater than the diameter of said roller means positioned within the inner periphery of said housing.

16. A hydraulic device comprising: a casing having a fluid inlet port and a fluid outlet port; an internally generated gerotor set received within said casing and encompassed thereby; said gerotor set having inner and outer toothed members which are cooperable to define N relatively high and low pressure variable volume chambers between toothed surfaces thereof; said inner member mounted upon a shaft for rotation about the fixed longitudinal axis of said shaft and having N circumferentially spaced teeth about the periphery of said inner member; said outer member mounted within said casing for orbital non-rotational movement and having N+1 generated, non-circular arcuate teeth on its inner peripheral surface; portions of said inner member between the teeth being in non-fluid sealing relation to the teeth of the outer member; a commutator within said casing having N+1 fixed inlet fluid passageways and N+1 fixed outlet fluid passageways, said inlet and outlet passageways being in fluid communication with the respective inlet and outlet ports; valve means having N ports rotatable with said inner member for providing synchronized fluid flow communication between the said variable volume chambers and said inlet and outlet passageways for the delivery of hydraulic fluid to said gerotor set at a first pressure and the discharge of such hydraulic fluid from said gerotor set at a second pressure, respectively, with one of said pressures being higher than the other of said pressures; said outer member being located within said casing to form an annular space of constant volume between said outer member and peripheral portions of said casing adjacent said outer member; and control means in said casing in fluid communication with the annular space for maintaining the fluid in said annular space below a predetermined pressure and thereby actively relieving pressure.

17. A hydraulic device as set forth in claim 11 wherein said control means comprises:

a. an elongated passageway means in said casing with one end portion being in fluid flow communication with said annular space and the other end portion being in fluid flow communication with either said inlet or outlet port, and one-way pressure regulating means carried by said casing and located at least in part within said elongated passageway means intermediate said end portions thereof for controlling fluid flow through said elongated passageway means from said gerotor set to maintain a preselected pressure in said chamber between the fluid pressures in said inlet and outlet ports.

18. A hydraulic device as set forth in claim 16 wherein said annular space extends around the entire outer periphery of said gerotor set.

19. A gerotor machine, comprising:

(a) a housing;

(b) a displacement unit in said housing;

(c) and including an inner gear member having an axis of rotation;

(d) and an outer gear member having a further axis circurlarly movable about axis of rotation of said inner gear member without rotating of said outer gear member about said further axis;

(e) said inner gear member having a plurality of teeth with teeth root sections and intermediate sections located between said teeth root sections;

(f) said gear members bounding a plurality of displacement chambers therebetween;

(g) and means for controlling a flow of pressure medium and including a plurality of radial groove-shaped recesses formed in said inner gear member at one axial side of the latter and each arranged in a respective one of said intermediate sections without extending into said teeth root sections;

(h) each of said radial groove-shaped recesses being bounded by two circumferentially spaced control edges;

(i) said flow controlling means further including a plurality of control openings formed in said housing and arranged relative to the axis of said inner gear member at a radial distance corresponding to that of said recesses;

(j) said control edges of said recesses cooperating with said control openings and being operative for controlling the communication of the latter with said displacement chambers.

20. A gerotor machine as defined in claim 19, wherein said inner gear member is located centrally in said housing.

21. A gerotor machine as defined in claim 19, wherein said inner gear member has a central plane extending in a direction transverse to the axis of the same, said recesses extending at most to said central plane of said inner gear member.

22. A gerotor machine as defined in claim 19, wherein said plurality of control openings includes a first group of openings operative for supplying the pressure medium to said displacement unit, and a second group of openings operative for withdrawing the pressure medium from the latter.

23. A gerotor machine as defined in claim 19, wherein said housing is composed of two housing parts, said displacement unit being located between said housing parts.

24. A gerotor machine as defined in claim 23, wherein said control openings are formed only in one of said housing parts.

25. A gerotor machine as defined in claim 24, wherein said one housing part includes a flat plate member which bounds said displacement unit at its one axial side and is loaded in a direction toward said displacement unit.

26. A hydraulic device comprising: a casing; an internally generated gear set received within said casing and encompassed thereby; said gear set having inner and outer toothed members which are cooperable to define relatively high and low pressure variable volume chambers between selected toothed surfaces thereof; said inner member mounted upon a shaft to rotation about the fixed longitudinal axis of said shaft and having a plurality of circumferentially spaced teeth about the periphery of said inner member; said outer member mounted within said casing for orbital movement and having multiple generated, non-circular arcuate teeth on its inner peripheral surface; said casing having inlet and outlet fluid ports in fluid flow communication with said variable volume chambers for the delivery of hydraulic fluid to said gear set at a first pressure and the discharge of such hydraulic fluid from said gear set at a second pressure, respectively, with one of said pressures being higher than the other of said pressures; said outer member being located within said casing to form an annular chamber of constant volume between said outer member and peripheral portions of said casing adjacent said outer member; and control means in said casing in fluid communication with the annular chamber for maintaining the fluid in said annular chamber below a selected pressure wherein said control means comprises an elongated passageway means in said casing with one end portion being in fluid flow communication with said annular chamber and the other end portion being in fluid flow communication with either said inlet or outlet port, and pressure regulating means carried by said casing and located at least in part within said elongated passageway intermediate said end portions thereof for controlling fluid flow through said elongated passageway from said gear set to maintain a preselected pressure in said chamber intermediate between the fluid pressures in said inlet and outlet ports, said pressure regulating means comprising a plunger biased to normally close said passageway and movable to open said passageway when the bias of said plunger is overcome by the fluid in said annular chamber when the pressure of said fluid exceeds said selected pressure.

27. A hydraulic device as set forth in claim 26 wherein spring means are cooperable with said plunger to bias said plunger.

28. A hydraulic device as set forth in claim 27 wherein the bias of said spring means is adjustable.

29. A hydraulic device as set forth in claim 27 wherein said other end portion of said passageway means is in fluid flow communication with at least one of said variable volume chambers by means of fluid leakage across faces of said gear set.

30. The motor of claims 3 or 8 wherein N is an odd integral number.

* * * * *